US009326359B2

(12) United States Patent
Bosua

(10) Patent No.: US 9,326,359 B2
(45) Date of Patent: Apr. 26, 2016

(54) LIGHTING SYSTEM OPERATION MANAGEMENT METHOD

(71) Applicant: LIFI Labs, Inc., Richmond (AU)

(72) Inventor: Philip Bosua, Victoria (AU)

(73) Assignee: LIFI Labs, Inc., San Francisco, CA (US)

( * ) Notice: Subject to any disclaimer, the term of this patent is extended or adjusted under 35 U.S.C. 154(b) by 0 days.

(21) Appl. No.: 14/843,855

(22) Filed: Sep. 2, 2015

(65) Prior Publication Data

US 2016/0066393 A1 Mar. 3, 2016

Related U.S. Application Data

(60) Provisional application No. 62/044,791, filed on Sep. 2, 2014.

(51) Int. Cl.
*H05B 37/02* (2006.01)

(52) U.S. Cl.
CPC ..... *H05B 37/0245* (2013.01)

(58) Field of Classification Search
CPC ..... H05B 37/02; H05B 37/0218; H05B 37/0227; H05B 37/0272; H05B 33/08; H05B 33/0815; H05B 33/0842; H05B 33/0845; H05B 33/0884; H05B 33/0896
USPC ..... 315/209 R, 291–297, 307, 308, 312
See application file for complete search history.

(56) References Cited

U.S. PATENT DOCUMENTS

| | | | |
|---|---|---|---|
| 4,942,386 | A | 7/1990 | Willis |
| 5,769,527 | A | 6/1998 | Taylor et al. |
| 5,841,428 | A | 11/1998 | Jaeger et al. |
| 6,759,966 | B1 | 7/2004 | Weng |
| 7,339,128 | B2 | 3/2008 | Yen |
| 7,446,671 | B2 | 11/2008 | Giannopoulos et al. |
| 7,474,632 | B2 | 1/2009 | Ban |
| 7,598,885 | B2 | 10/2009 | Kwon et al. |
| 7,859,398 | B2 | 12/2010 | Davidson et al. |
| 7,884,556 | B2 | 2/2011 | Gandhi |
| 7,980,726 | B2 | 7/2011 | Joosen et al. |
| 8,035,320 | B2 | 10/2011 | Sibert |
| 8,100,552 | B2 | 1/2012 | Spero |
| 8,195,313 | B1 | 6/2012 | Fadell et al. |
| 8,253,344 | B2 | 8/2012 | Guest et al. |
| 8,282,250 | B1 | 10/2012 | Dassanayake et al. |
| 8,294,379 | B2 | 10/2012 | Liu et al. |
| 8,299,719 | B1 | 10/2012 | Moshirnoroozi |
| 8,446,288 | B2 | 5/2013 | Mizushima et al. |
| 8,523,410 | B2 | 9/2013 | Hashimoto et al. |
| 8,581,512 | B2 | 11/2013 | Hamamoto et al. |

(Continued)

FOREIGN PATENT DOCUMENTS

| | | | |
|---|---|---|---|
| CN | 203099410 | U | 7/2013 |

*Primary Examiner* — Jimmy Vu

(74) *Attorney, Agent, or Firm* — Jeffrey Schox; Diana Lin

(57) ABSTRACT

A method for automatic lighting system control, including: receiving a first light parameter value selection from a user account associated with the lighting system; controlling lighting elements of the lighting system to meet the first light parameter value; automatically determining a second light parameter value based on the first light parameter value and a user perception profile relating light parameter values with perceived light output values; and incrementally adjusting lighting element operation to meet the second light parameter value over a predetermined time period.

20 Claims, 6 Drawing Sheets

(56) References Cited

U.S. PATENT DOCUMENTS

| | | | | |
|---|---|---|---|---|
| 8,593,073 | B2 | 11/2013 | Aldrich et al. | |
| 8,742,694 | B2 | 6/2014 | Bora et al. | |
| 8,755,561 | B2 * | 6/2014 | Vlutters | H05B 37/02 362/16 |
| 8,764,251 | B2 | 7/2014 | Lien | |
| 8,812,827 | B2 | 8/2014 | Malasani | |
| 8,820,984 | B2 | 9/2014 | Gillio | |
| 8,981,913 | B2 | 3/2015 | Henig et al. | |
| 2004/0105264 | A1 | 6/2004 | Spero | |
| 2007/0182367 | A1 | 8/2007 | Partovi | |
| 2008/0218099 | A1 | 9/2008 | Newman | |
| 2009/0295310 | A1 | 12/2009 | Duerr et al. | |
| 2010/0068899 | A1 | 3/2010 | Shvili | |
| 2011/0050120 | A1 | 3/2011 | Leung et al. | |
| 2011/0089838 | A1 | 4/2011 | Pickard et al. | |
| 2011/0163683 | A1 | 7/2011 | Steele et al. | |
| 2011/0285515 | A1 | 11/2011 | Fushimi et al. | |
| 2012/0025717 | A1 | 2/2012 | Klusmann et al. | |
| 2012/0126699 | A1 | 5/2012 | Zittel | |
| 2012/0195053 | A1 | 8/2012 | Wu | |
| 2012/0206050 | A1 | 8/2012 | Spero | |
| 2012/0300441 | A1 | 11/2012 | Thomas et al. | |
| 2013/0038230 | A1 | 2/2013 | Brown et al. | |
| 2013/0063042 | A1 | 3/2013 | Bora et al. | |
| 2013/0148341 | A1 | 6/2013 | Williams | |
| 2013/0193847 | A1 | 8/2013 | Recker et al. | |
| 2013/0257312 | A1 | 10/2013 | Maxik et al. | |
| 2013/0278172 | A1 | 10/2013 | Maxik et al. | |
| 2014/0043825 | A1 | 2/2014 | Brandes et al. | |
| 2014/0084809 | A1 | 3/2014 | Catalano | |
| 2014/0239811 | A1 | 8/2014 | Kreiner et al. | |
| 2014/0300293 | A1 | 10/2014 | Ruan et al. | |
| 2015/0048760 | A1 | 2/2015 | Kwag et al. | |
| 2015/0084513 | A1 | 3/2015 | Anthony et al. | |

* cited by examiner

LIGHTING SYSTEM OPERATION MANAGEMENT METHOD

CROSS-REFERENCE TO RELATED APPLICATIONS

This application claims the benefit of U.S. Provisional Application No. 62/044,791 filed 2 Sep. 2014, which is incorporated in its entirety by this reference.

This application is related to U.S. patent application Ser. No. 14/512,669 filed 13 Oct. 2014, U.S. patent application Ser. No. 14/720,180 filed 22 May 2015, and PCT Patent Application Number PCT/AU2014/000235 filed 11 Mar. 2014, which are incorporated in their entireties by this reference.

TECHNICAL FIELD

This invention relates generally to the power management field, and more specifically to a new and useful system and method of power consumption control by lighting elements in the power consumption field.

DESCRIPTION OF THE PREFERRED EMBODIMENTS

The following description of the preferred embodiments of the invention is not intended to limit the invention to these preferred embodiments, but rather to enable any person skilled in the art to make and use this invention.

Figure 1:
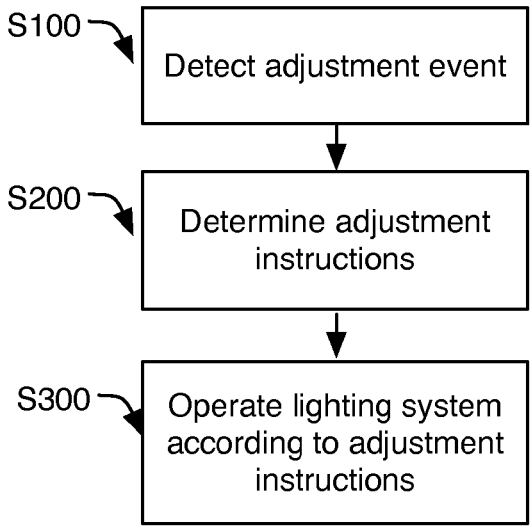
FIG. 1 is a schematic representation of the method of lighting system operation management.
Figure 2:
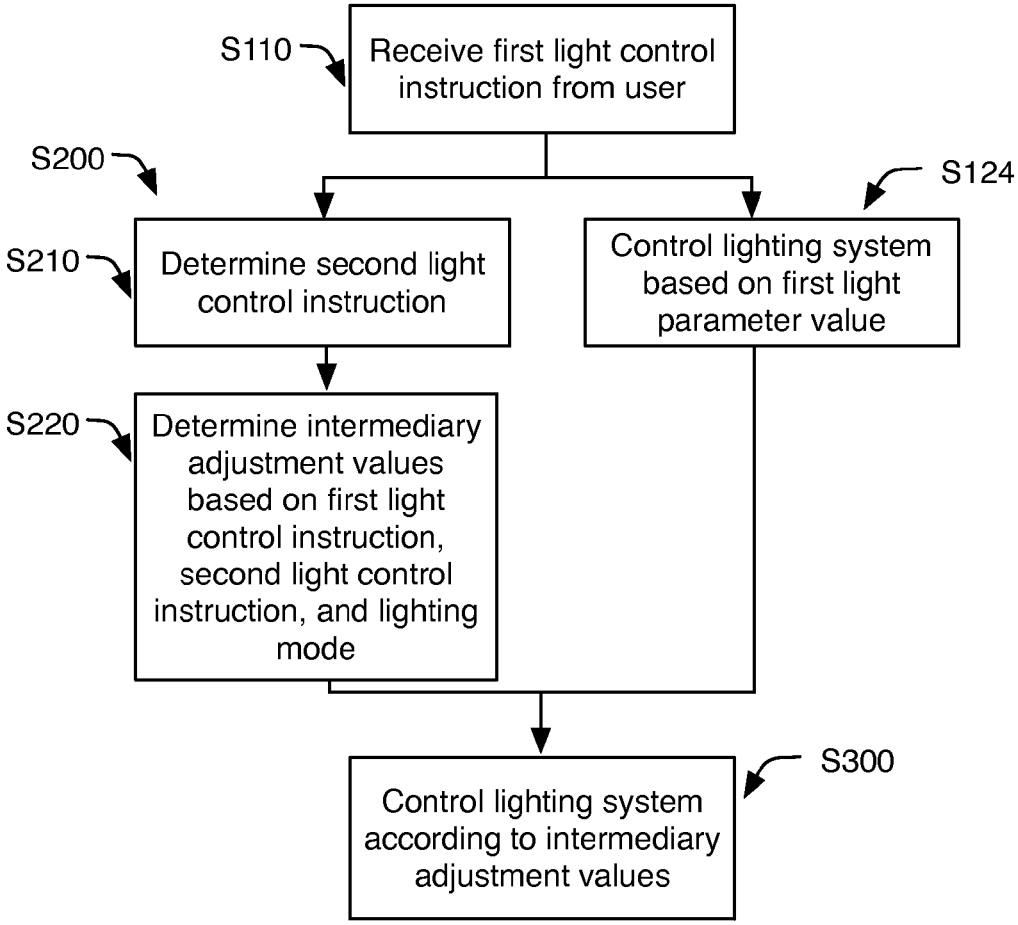
FIG. 2 is a schematic representation of a variation of the method.

As shown in FIG. 1, the method for lighting system management includes detecting an adjustment event S100, determining adjustment instructions for a lighting system S200, and adjusting lighting system operation based on the adjustment instructions S300. The method functions to gradually adjust the parameters of the light output by a lighting system such that a human user does not consciously perceive the change. In a specific example, the method can adjust a lighting system's power consumption while substantially maintaining or approximating the amount of light that is perceived by the user.

The inventors have discovered that humans will not consciously perceive (e.g., noticeably) gradual adjustment of ambient light parameters, due to their unconscious physical reactions that accommodate for such changes (e.g., pupil dilation). This method leverages this discovery to achieve the same or similar perceived lighting qualities while changing the actual light that is provided, which enables user experience and/or lighting system consumption adjustment. In one variation, the method both: accommodates for differences between the actual and perceived light output (due to pupil dilation) for light having a given set of lighting parameters; and leverages the effect of pupil dilation on perceived light by gradually (e.g., imperceptibly) change the parameters of the light to achieve a set goal.

The method can be used with a user account, but can alternatively be used without a user account. The user account is preferably stored by the remote computing system, but can alternatively be stored by the user device 200, lighting system (s), or by any other suitable computing system. The user account is preferably associated with the user device (e.g., via an application login) and/or one or more lighting systems (e.g., via an identifier for the lighting system). The user account can include user preferences, user perception profiles, or include any other suitable user information.

Figure 3:
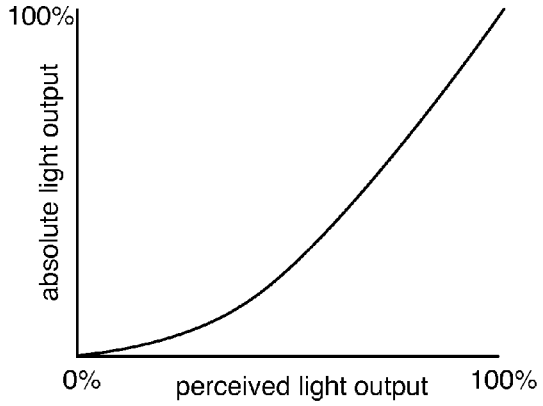
FIG. 3 is an example of a user perception profile relating an absolute light output with a perceived light output (e.g., used to interpret a light parameter value selection from the user).
Figure 4:
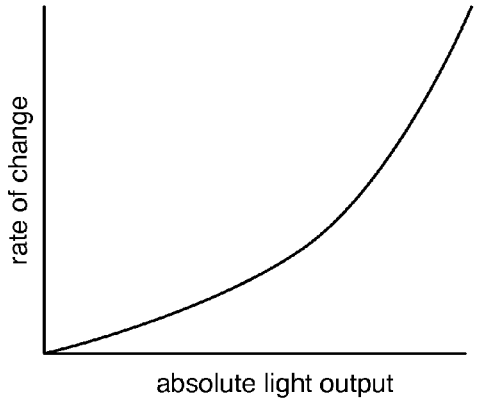
FIG. 4 is an example of a user perception profile relating an absolute light output with a rate of change for a user (e.g., used to determine the lighting parameter rate of change).
Figure 5:
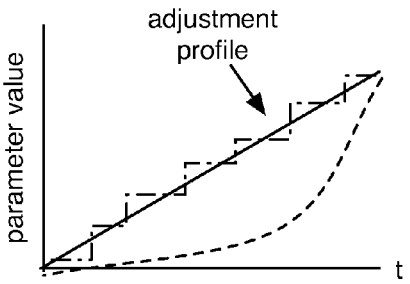
FIG. 5 is a schematic representation of three examples of parameter adjustment profiles to increase the parameter value from a first value to a second value.
Figure 6:
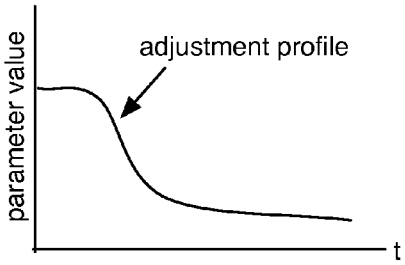
FIG. 6 is a schematic representation of a parameter adjustment profile to decrease the parameter value from a first value to a second value.
Figure 7:
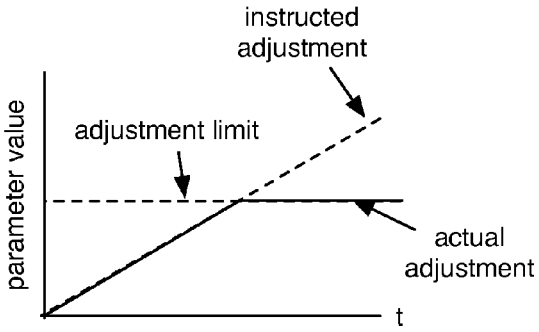
FIG. 7 is a schematic representation of parameter adjustment accounting for an adjustment limit.

The user perception profile can be universal, unique to a user (e.g., unique to a user account), unique to a user population, or be shared amongst any other suitable set of users. The user perception profile can be static (e.g., not change over time), change based on context (e.g., based on time of day, a user schedule, etc.), change based on user inputs (e.g., adjusted based on user responses to the automatic light parameter adjustment), or change in any other suitable manner. The user perception profile can be a function, a graph or chart, or be any other suitable relationship. The user perception profile preferably relates an absolute light output (measured light output, lighting system light output) with a perceived light output, an example of which is shown in FIG. 3. Additionally or alternatively, the user perception profile can relate an absolute light output value with a rate of change (example shown in FIG. 4), an absolute light output value with time (examples shown in FIGS. 5 and 6), or relate light output (absolute or perceived) with any other variable. The absolute light output can be a measure of the light actually output by the lighting system, while the perceived light output can be a measure of the output light, as perceived by a user. However, the absolute light output and perceived light output can be otherwise defined. A user account can be associated with one or more user perception profiles. Multiple profiles associated with a user account can differ in context, types of variables related within the user perception profile, or vary in any other suitable manner.

In a first variation, as shown in FIG. 3, the user perception profile relates absolute light intensity with perceived light intensity, which can accommodate for pupil dilation. Examples of absolute light intensity include luminous flux, illuminance, and radiant flux, but can alternatively or additionally include any other suitable measure of the actual light output by the lighting system. Examples of perceived light intensity include perceived luminous flux, perceived illuminance, and perceived radiant flux, but can alternatively or additionally include any other suitable measure of the perceived light that is output by the lighting system.

In a second variation, the user perception profile relates the wavelength of output light with perceived light intensity, which can accommodate for different eye sensitivities to different light wavelengths. Examples of user perception profiles for this variation include photopic luminosity functions (standard or modified), scotopic luminosity functions, or any other suitable relationship between wavelength and perceived light intensity. However, the user perception profile can relate the actual and perceived values of any set of light parameters in any other suitable manner.

The method can be performed by a remote system 300, a user device 200, the lighting system 100, or by any other suitable computing system. The remote system is preferably a remote server system, but can alternatively be any other suitable remote computing system. The remote system is preferably remote from the lighting system (e.g., beyond a threshold distance from the lighting system, not physically connected to the lighting system, etc.), but can be otherwise remote.

The lighting system 100 functions to output light, provide sensor measurements, and/or perform part or all of the method. The lighting system preferably includes a data receiver and processor, and can additionally include or be connected to one or more lighting elements, sensors (e.g., ambient light sensors), or any other suitable component. The data receiver is preferably a wireless receiver (e.g., a Bluetooth receiver, WiFi antenna, light sensor, etc.), but can alternatively be a wired receiver (e.g., an Ethernet system) or any other suitable data receiver. The data receiver is preferably part of a transmitter receiver pair, but can alternatively be an independent receiver or any other suitable system capable of receiving the information. Examples of data transceiver protocols include WiFi, Zigbee, NFC, RF, IR, Bluetooth, beacon, or include any other suitable protocol. The lighting system can support one or more protocols. The lighting system can function as a router, repeater, or perform any other suitable function. The processor preferably functions to process the instructions and control the lighting elements. The lighting system can additionally include storage (e.g., RAM, flash memory, etc.), power storage (e.g., a battery), or include any other suitable component. The lighting system is preferably connected to a power source. The power source can be a power grid, battery (e.g., wherein the battery is located within the lighting system and can be rechargeable and/or removable), renewable power source (e.g., solar system, turbine system, etc.), or be any other suitable power source. The lighting system can additionally include a lighting element correction factor or lighting parameter-to-power input map for each lighting element (stored on the lighting system or retrievable from an external storage system), which can be used by the processor (e.g., while determining the control instructions) to correct for manufacturing differences between different lighting elements. In a first variation, the lighting system can be a lightbulb including a set of lighting elements (e.g., LEDs, OLEDs, etc.). In a second variation, the lighting system can be a set box connected to a set of lightbulbs, wherein the set box controls operation of the set of lightbulbs. However, the lighting system can be any other suitable system. Each lighting system can be associated with one or more user accounts. In one variation, a lighting system only performs the method for user accounts associated with the lighting system. Alternatively, the lighting system can perform the method for any user device, user account, or other computing system in communication with the lighting system.

The method can additionally be used with a user device 200. The user device is preferably a mobile device (e.g., a smartphone), but can alternatively be a laptop, tablet, or any other suitable computing device. The user device preferably includes a user input (e.g., a keyboard, touchscreen, microphone etc.), a user output (e.g., a display, such as an OLED, LED, plasma, or other digital display, a light, a speaker, etc.), a processor, and a data transmitter (e.g., complimentary to the data receiver of the lighting system). The user device can additionally include a set of sensors, such as an ambient light sensor, a position sensor (e.g., GPS sensor), an image sensor (e.g., camera), an audio sensor (e.g., microphone), or any other suitable sensor or component.

Detecting the adjustment event S100 functions to detect a trigger event that triggers lighting system parameter adjustment. The adjustment event is preferably detected by the component generating the instructions, but can alternatively be detected by a separate component. The adjustment event can be detected by the user device, lighting system, remote system, or by any other suitable component. The adjustment event can be the receipt of a lighting system control instruction, receipt of a lighting system operation mode from a user (e.g., at a user device, through a user account, etc.), determination of a change in an ambient environment parameter (e.g., ambient light) beyond a threshold change, determination that an ambient environment parameter value exceeds a threshold value, determining a change in the state of a secondary component (e.g., a change in the state of charge of a power source), determining that a state or parameter of a secondary component exceeds or meets a threshold state or parameter value (e.g., a power source SOC exceeding a threshold SOC), or can be any other suitable event. The adjustment event can alternatively be determined based on a user pupil dilation measurement (e.g., diameter, percentage, etc.), as determined by a sensor located on a lighting system, user device, or any other suitable device. The adjustment event can alternatively be determined based on an instantaneous or past combination of contextual parameters (e.g., ambient environment parameters, user proximity, time, etc.). However, any other suitable adjustment event can be determined.

The operation mode functions to specify a pattern or goal for automatic lighting system operation adjustment. Examples of operation modes that can be selected by a user include a power reduction mode (e.g., econo-mode), wherein instructions are generated to decrease power consumption by the lighting system; a warming or cooling mode, wherein instructions are generated to increase or decrease the perceived thermal temperature of the room by adjusting the visual temperature of the emitted light; a light parameter maintenance mode, wherein instructions are generated to maintain the light parameter value of the ambient environment (e.g., accommodate for the setting or rising sun); a mood adjustment mode, wherein instructions are generated to increase or decrease the hue or color temperature to adjust a user mood; or include any other suitable operation mode. However, any other suitable mode associated with adjustment of any other suitable light parameter can be included. The operation mode can be received from the user or automatically determined (e.g., retrieved from storage). The operation mode can be stored by (and retrieved from) the lighting system memory, the remote system, the user device, or any other suitable system. In one variation, lighting system operation adjustment is performed in response to receipt of the operation mode. In a second variation, the operation mode can be pre-associated with the lighting system before the adjustment event is detected.

Receiving lighting system control instructions S110 function to receive instructions for lighting system operation adjustment, such that parameters of the light, output by the lighting system (lighting parameters), can be changed. The lighting system control instructions can be received from the user (e.g., entered by the user at the user device), automatically generated and received from a computing system (e.g., the user device, user account, remote system, etc.), or be determined or received in any other manner. The control instructions can be received from a user proximal the system (e.g., within a predetermined distance of the lighting system, within eyesight of the lighting system, etc.), or remote from the system (e.g., beyond a predetermined distance of the lighting system, outside of a visible range of the lighting system, etc.). The lighting system control instructions can include a target value for the lighting parameter (first lighting parameter value) S112, control instructions for the lighting element (e.g., a duty cycle selection, current magnitude selection, etc.), or include any other suitable set of instructions. Examples of lighting parameters that can be specified and controlled by the control instructions include light intensity, color temperature, saturation, hue, lighting element subsets (e.g., in lighting system variants including individually indexed and controllable lighting elements), or include any other suitable lighting parameter.

Receiving the first lighting system control instructions S110 can additionally include controlling the lighting system based on the first lighting system control instructions. In this variation, the lighting system can emit light having a preliminary set of lighting parameter values prior to first lighting system control instruction receipt, wherein the first lighting system control instruction specifies adjustment of a subset of the preliminary set of lighting parameter values. Alternatively, the lighting system can be off or operating in any other suitable state prior to first lighting system control instruction receipt. The lighting system can be controlled according to the first lighting system control instructions, controlled to meet the first lighting system control instructions, or otherwise controlled based on the first lighting system control instructions. The lighting system is preferably controlled based on the first lighting system control instructions after control instruction receipt (e.g., at the lighting system), but can additionally or alternatively be performed before automatic lighting element control instruction determination, lighting element control, or at any other suitable time. The lighting system can be controlled by the lighting system processor, user device, remote system, or by any other suitable system.

In one example, the lighting system responds to the first lighting system control instruction (e.g., operates according to the control instruction) in real- or near-real time. The user can adjust lighting system operation by entering inputs within an application running on the user device, wherein first lighting system control instructions can be generated based on the inputs. For example, the user can adjust the hue of the light emitted by the lighting system in near-real time by scrolling a color wheel rendered on the user device (e.g., the interface disclosed in PCT/AU2014/000235, but alternatively any other suitable interface), wherein the hue of the emitted light changes at approximately the same rate as wheel rotation.

When the control instructions include target values, controlling the lighting system based on the control instructions can include: determining lighting element control instructions based on the target values S122, and operating the lighting element(s) of the lighting system according to the lighting element control instructions S124. This can function to control the lighting elements of the lighting system to cooperatively output light that substantially satisfies (e.g., meets) the target values. However, the target values can be processed in any other suitable manner. Lighting element control instructions can include: a pulse width modulation (PWM) duty cycle, current parameters (e.g., magnitude), voltage parameters (e.g., magnitude, direction), lighting element identifiers, or instructions for any other suitable lighting element control method. In one example, each current magnitude can correspond to a specific lighting parameter value, such as a specific light intensity.

Figure 9:
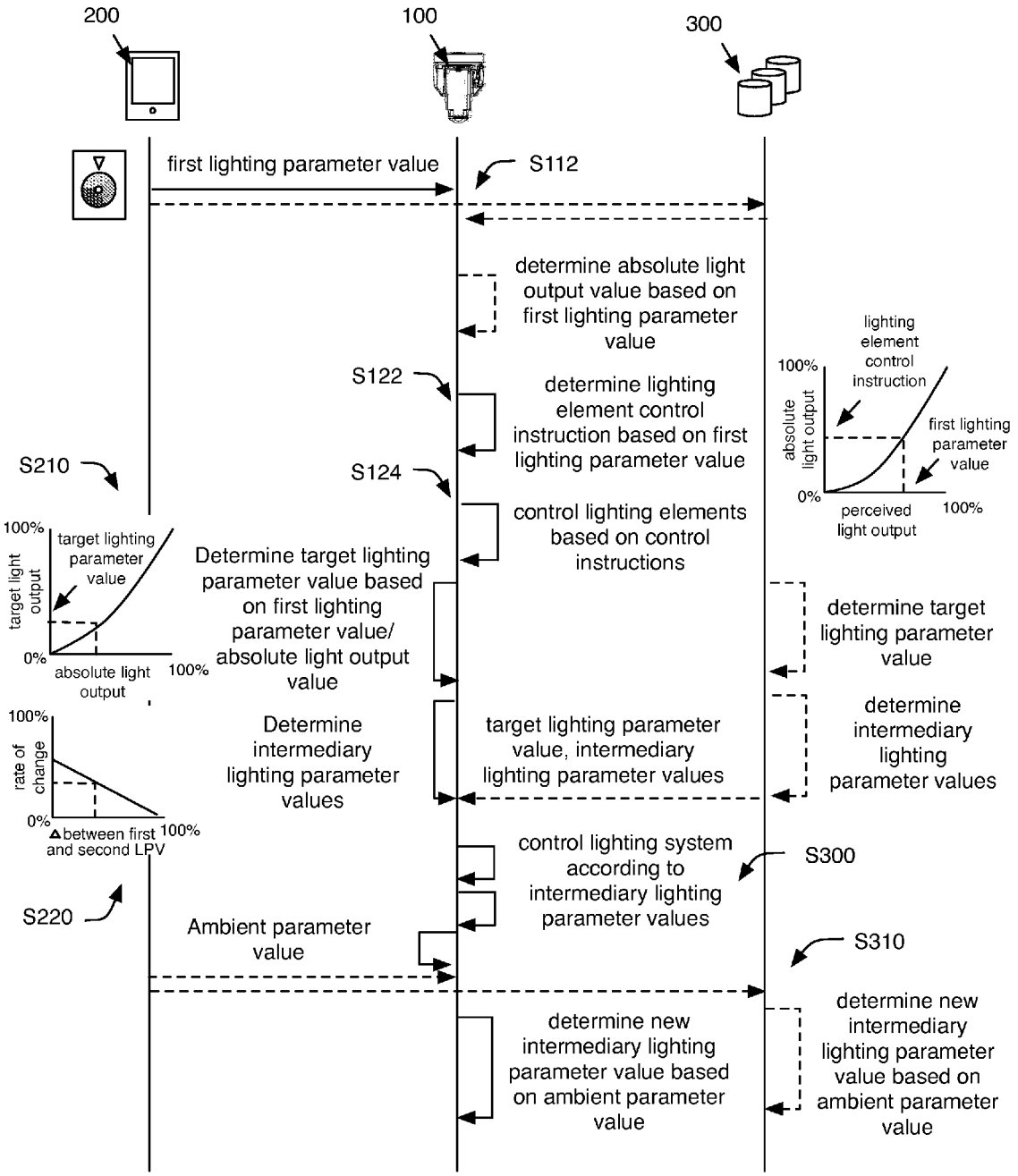

In one variation, the target value specifies an absolute light output, wherein the lighting elements are controlled to meet the absolute light output value. For example, the target value can specify an absolute light intensity, wherein the current supplied to the lighting elements and/or the duty cycle for the lighting elements is adjusted such that the lighting elements output light at the specified absolute light intensity. In a second variation (example shown in FIG. 9), the target value specifies a perceived light output, wherein the method can include: determining an absolute light output value corresponding to the perceived light output value; and controlling the lighting elements to output light at the respective absolute light output value. However, the lighting system can be otherwise controlled in response to receipt of the control instructions.

Determining adjustment instructions for the lighting system S200 functions to generate instructions that will enable the lighting system to emit light that will meet a desired goal, wherein the goal is based on the adjustment event. Determining the adjustment instructions can additionally function to generate lighting system control instructions that will minimize user perception of the light parameter change.

In a first example, adjustment instructions to gradually decrease the intensity of emitted light (and thereby decrease the amount of power consumed by the lighting system) can be generated in response to receipt of a power conservation mode selection. In a second example, adjustment instructions to gradually adjust the hue of the emitted light towards a redder hue (and thereby decrease the amount of power consumed by the lighting system) can be generated in response to receipt of a power conservation mode selection. In a third example, adjustment instructions to gradually decrease the color temperature of the emitted light can be generated in response to receipt of a warming selection (e.g., wherein the color temperature can influence a perceived thermal temperature). In a fourth example, adjustment instructions to gradually increase the intensity of the emitted light (and thereby increase the amount of power consumed by the lighting system) can be generated in response to the anticipated power to be supplied from a renewable power source (e.g., a solar power system) exceeding the capacity of the power source's power storage (e.g., battery). In a fifth example, adjustment instructions to gradually adjust the hue of the emitted light toward a bluer hue and gradually decrease the emitted light intensity can be generated in response to receipt of a power conservation mode selection.

In a first variation, the adjustment instructions are predetermined, and can be constant across all adjustments or be selected based on the first lighting system control instruction, lighting mode, or otherwise selected. In a second variation (example shown in FIG. 8), determining adjustment instructions can include determining a second lighting system control instruction S210 and generating incremental control instructions to achieve the second lighting system control instruction S220. However, the adjustment instructions can be otherwise determined.

Determining a second lighting system control instruction for the lighting system S210 functions to identify a target endpoint for lighting system operation. For example, a lower power-consuming light parameter value, such as a lower light intensity value or a redder light hue can be selected as the target endpoint (the second lighting system control instruction) when the lighting system is operating under a power reduction mode. The second lighting system control instruction is preferably automatically determined (e.g., without user input, without intervening user input between initial control instruction receipt and subsequent adjustment, etc.) by the user device, remote system, lighting system, secondary lighting system, or any other computing system, but can alternatively be received from a user or be otherwise determined. The second lighting system control instructions can be determined after the first lighting system control instructions have been received, after the lighting system has executed the lighting system control instructions, or at any other suitable time. The second lighting system control instruction can be a target value (e.g., second lighting parameter value), a set of control instructions (e.g., lighting system control instructions, lighting element control instructions, etc.), or be any other suitable set of instructions. The second lighting parameter for which a value is determined can be the same lighting parameter as first lighting parameter, a different lighting parameter from the first lighting parameter, or be any other suitable lighting parameter. The second lighting parameter value is preferably different from the first lighting parameter value, but can alternatively be substantially similar.

The second lighting parameter value can be determined based on the first lighting system control instruction (e.g., first lighting parameter value), the current set of lighting parameter values (e.g., including hue, intensity, saturation, color temperature, etc.), a user perception profile (e.g., associated with the user account from which the control instruction was received, a universal profile, etc.), the lighting system operation mode, the value of one or more ambient environment parameters (ambient parameter values), or be determined based on any other suitable factor. Examples of ambient parameters for which values can be determined include: ambient light parameters, ambient sound parameters (e.g., amplitude, tone), ambient temperature, ambient pressure, or include any other suitable ambient variable.

Determining the second lighting parameter value S210 can include calculating, selecting, interpolating, or otherwise selecting the lighting parameter value. In one variation of second lighting parameter value determination, the second lighting parameter value is calculated based on a function and the first lighting parameter value. In one example, the second lighting parameter value is calculated as a predetermined percentage of the lighting parameter value. The predetermined percentage can be 80%, 90%, between 50-100%, between 10%-90%, or be any other suitable percentage. The predetermined percentage can be constant, selected based on the first light parameter value, selected based on the lighting mode, or be determined in any other manner. In one example, the higher the first light parameter value (e.g., light intensity), the higher predetermined percentage, and the lower the first light parameter value, the lower the predetermined percentage.

Alternatively, the second lighting parameter value is determined based on the user perception profile. In a first variation, the first lighting parameter value is an absolute light output value, and determining the second lighting parameter value can include: determining a first perceived light output value corresponding to the first absolute light output value based on the user perception profile; determining a second perceived light output value based on the first perceived light output value (e.g., wherein the second perceived light output value is a percentage of the first perceived light output value); and determining the second absolute light output value corresponding to the second perceived light output value based on the user perception profile. In a second variation, the first lighting parameter value is a perceived light output value, wherein the user perception profile is used to determine the absolute light output value corresponding to the first perceived light output value. The method can additionally include: determining a second absolute light output value based on the first absolute light output value (e.g., as a percentage of the first absolute light output value). Alternatively, the method can include: determining a second perceived light output value based on the first perceived light output value (e.g., as a percentage of the first perceived light output value), and determining the second absolute light output value based on the second perceived light output value and the user perception profile. However, the second light parameter value can be otherwise determined.

Generating adjustment control instructions to achieve the second lighting system control instruction S220 functions to generate control instructions for substantially imperceptible lighting system and/or lighting element operation adjustment. The adjustment control instructions (transitory control instruction, intermediary control instructions) can be automatically generated or manually generated. The adjustment control instructions can be generated in response to receipt of the first lighting system control instruction, in response to lighting mode receipt, or in response to the occurrence of any other suitable adjustment event.

In a first variation, control instructions for each adjustment increment can be generated. Generating incremental adjustment control instructions can include: determining a plurality of adjustment times based on a predetermined time period S221, and determining an intermediary control instruction (lighting system control instruction or lighting element control instruction) for each adjustment time S222, wherein the lighting elements are operated based on an intermediary control instruction at the respective adjustment time.

The predetermined time period (adjustment time period) is preferably non-zero, but alternatively be instantaneous or be any period of time. The predetermined time period can be a universal, constant time period; be determined based on the first lighting parameter value, the second lighting parameter value, a percentage difference between the first and second lighting parameter value, an absolute difference between the first and second lighting parameter value, and/or the lighting mode; be selected by a user; be automatically determined based on a population of users (e.g., wherein the users share a geographic region, habits, or any other suitable feature), or be otherwise determined.

In a first example, the higher the first light intensity value, the shorter the adjustment period, and the lower the first light intensity value, the faster the adjustment period. In a second example, the closer the first hue to 550 nm, the shorter the adjustment period, and the further the first hue from 550 nm, the longer the adjustment period. In a third example, the adjustment time period for a positive mood operation mode is shorter than the adjustment time period for a negative mood operation mode. However, the adjustment time period can be determined in any other suitable manner.

The adjustment times preferably extend between a first time and a second time, wherein the first and second times are separated by the predetermined time duration. However, the adjustment times can extend along any suitable time duration. The adjustment times can be isochronal (evenly spaced), unevenly spaced (e.g., initially closer, then increasing in spacing with progression; initially further, then decreasing in spacing with progression; etc.), or otherwise arranged.

Determining the intermediary control instruction S222 functions to determine target light parameter values for each adjustment time, such that the light parameter can be gradually adjusted from the first light parameter value to the second light parameter value. The intermediary control instruction is preferably determined based on the first light parameter value, the second light parameter value, and an adjustment profile. The adjustment profile can specify the pattern of light parameter value adjustment. Examples of adjustment profiles include: linear adjustment logarithmic adjustment, parabolic adjustment, hyperbolic adjustment, exponential adjustment, or adjustment according to any suitable pattern. In one example, successive light parameter values are separated by an adjustment increment. The adjustment increment can be predetermined (e.g., based on the limits of human perception), empirically determined, or otherwise determined.

In a second variation of control instruction generation S220, lighting element operation can be adjusted iteratively. In one example, the light parameter value can be adjusted by a predetermined percentage until a stop event is met (e.g., until the second light parameter value is met, until a predetermined time period is met, etc.). In a second example, the next intermediary light parameter value is determined after each lighting element operation adjustment, based on the adjustment profile and the difference between the current light parameter value and the second light parameter value. In a second example, the lighting parameter value is adjusted according to the adjustment instructions as long as the adjustment rate is below the adjustment rate limit. In response to the instructed adjustment rate exceeding the adjustment rate limit, the lighting system operation parameter value can be adjusted at the adjustment rate limit. However, the lighting system operation parameter value can be adjusted in any other suitable manner. In a third example, the lighting parameter is adjusted according to the adjustment instructions as long as the total parameter value change is below the adjustment limit. In response to the instructed amount of adjustment exceeding the adjustment limit, lighting parameter value adjustment is preferably halted at the adjustment limit. However, the parameter value can be adjusted beyond the adjustment limit, or otherwise adjusted.

The adjustment limit can be predetermined (e.g., based on the limits of human perception), empirically determined (e.g., by iteratively testing adjustment values and identifying the values that the user responded to by adjusting the light parameter and which values that the user did not respond to), selected based on the detected adjustment event (e.g., from a chart, graph, etc.), selected based on ambient environment properties, selected based on lighting system properties (e.g., position of the lighting system relative to a reference point, such as a user, starting lighting system operation parameter values, starting lighting system operation parameter values, etc.), selected based on user parameters (e.g., instantaneous or prior user activity), calculated based on the adjustment event, selected based on the instantaneous or past context, or otherwise determined. However, lighting element operation can be otherwise iteratively adjusted.

In a third variation, the lighting element operation can be adjusted at a predetermined rate for the set of light parameters (e.g., unit change or percentage change). In a first example, the adjustment instructions can include decreasing the emitted light intensity by 30% over 30 minutes in response to receipt of a power conservation instruction. In a second example, the adjustment instructions can include increasing the average emitted wavelength by 5 nm/minute for an hour. In a third example, the adjustment instructions can include increasing the emitted light intensity by 10 lumens over 10 minutes.

Adjusting lighting system operation based on the adjustment instructions S300 functions to adjust lighting system operation to meet the second light parameter value. In one example, adjusting lighting system operation based on the adjustment instructions includes adjusting lighting element operation to meet the second lighting system control instructions. The lighting element operation is preferably adjusted in a manner that minimizes user perception of the light parameter change, but can alternatively be adjusted in any other suitable manner. The lighting element operation can be adjusted after first lighting system control instruction receipt, lighting system operation based on the first lighting system control instruction, second light parameter value determination, or be adjusted at any other suitable time. Lighting element operation can be adjusted based on the first light parameter value, second light parameter value, the lighting mode, the user perception profile, or be adjusted based on any other suitable factor. Lighting element operation is preferably controlled by the processor of the lighting system (e.g., by controlling the PWM duty cycle, the amount of current supplied to the lighting elements, the voltage applied across the lighting elements, etc.), but can alternatively be controlled by any other suitable component or computing system.

Adjusting the lighting element operation S300 can additionally include accommodating for changes in the environment proximal the lighting system (ambient environment) during lighting element operation adjustment. Accommodating for ambient environment changes S310 can include: recording an ambient parameter value S310 and changing a successive intermediary lighting parameter value based on the ambient parameter value (example shown in FIG. 9). Ambient parameter values that can be recorded include: ambient light, ambient temperature, ambient pressure, ambient sound, or any other suitable parameter. The ambient parameter values can be determined by the user device (e.g., by sensors on the user device), the lighting system (e.g., sensors on the lighting system), a remote system (e.g., based on content feeds, such as weather reports), or be determined by any other suitable system in any manner. New intermediary lighting parameter values and/or secondary lighting parameter values can be determined to: maintain the predetermined rate of change (e.g., as perceived by the user), accommodate a different operation mode, or be determined for any other reason.

In one example, accommodating for the ambient parameter change includes, for a physical area: determining an intermediary illuminance value for each of a set of adjustment times; determining a control instruction (e.g., actual light intensity value) for each intermediary illuminance value; adjusting the lighting element operation according to the control instruction at the respective adjustment times; concurrent with lighting element operation adjustment, recording a measurement indicative of the illuminance value for the physical area; and, in response to determination of a mismatch between the measured illuminance value and the intermediary illuminance value for the last adjustment time, determining a new control instruction for the next intermediary illuminance value based on the difference (indicative of an unanticipated change in the light output by an external light source) and the target illuminance value (second illuminance value); and controlling the lighting element based on the new control instructions. However, changes in the ambient environment can be otherwise accommodated.

The method can additionally include adjusting the user interface on the user device, based on the automatic light parameter adjustment S320. In a first example, a light intensity setting represented on the user interface can be decreased as the light emitted by the lighting elements is changed (e.g., wherein the user interface reflects the actual light output). In a specific example, the user selects an 80% light intensity as the first light parameter value on the user interface (e.g., using a slider). The lighting system is controlled to initially emit light at 80% the maximum light intensity, and is gradually dimmed to emit light at 65% the maximum light intensity. The user interface can reflect this dimming, wherein the method can include sending the user device the intermediate light parameter value such that the user device can change the selected percentage on the user interface at the adjustment time.

In a second example, a light intensity setting represented on the user interface can be remapped as the light emitted by the lighting elements is changed (e.g., wherein the user interface reflects the perceived light output). In a specific example, the user selects an 80% light intensity as the first light parameter value on the user interface (e.g., using a slider). The lighting system is controlled to initially emit light at 80% the maximum light intensity, and is gradually dimmed to emit light at 65% the maximum light intensity. The user interface can remain at 80% intensity, wherein the 80% setting on the user interface is dynamically remapped to the 65% actual light intensity. In this example, the method can additionally include sending the actual light intensity to the user device as the actual light intensity is changed, such that the user device dynamically remaps the user-selectable light intensities to the actual light intensity. The remapping can be reset in response to lighting system shutdown, power provision cessation, or in response to the occurrence of any other suitable event. The method can additionally include: receiving a new user selection at the user device, determining a difference between the prior user selection and the new user selection (e.g., an absolute difference or a percentage difference), and controlling the lighting system based on the difference between the selection values. This can confer a better user experience by preserving the expected, relative adjustment between light intensities. Alternatively, the lighting system can be operated based on the absolute, unadjusted intensity value associated with the new user selection.

The method can additionally include learning user preferences S330, which functions to accommodate for differences in user perception (e.g., differences in user sensitivity to changes in light parameters). For example, a first user might be very sensitive to a light intensity change from 91% to 90% maximum intensity, while a second user may not notice the change at all. User preferences and/or sensitivities can be: received from the user, learned from user responses to lighting system adjustment, or otherwise determined.

Figure 8:
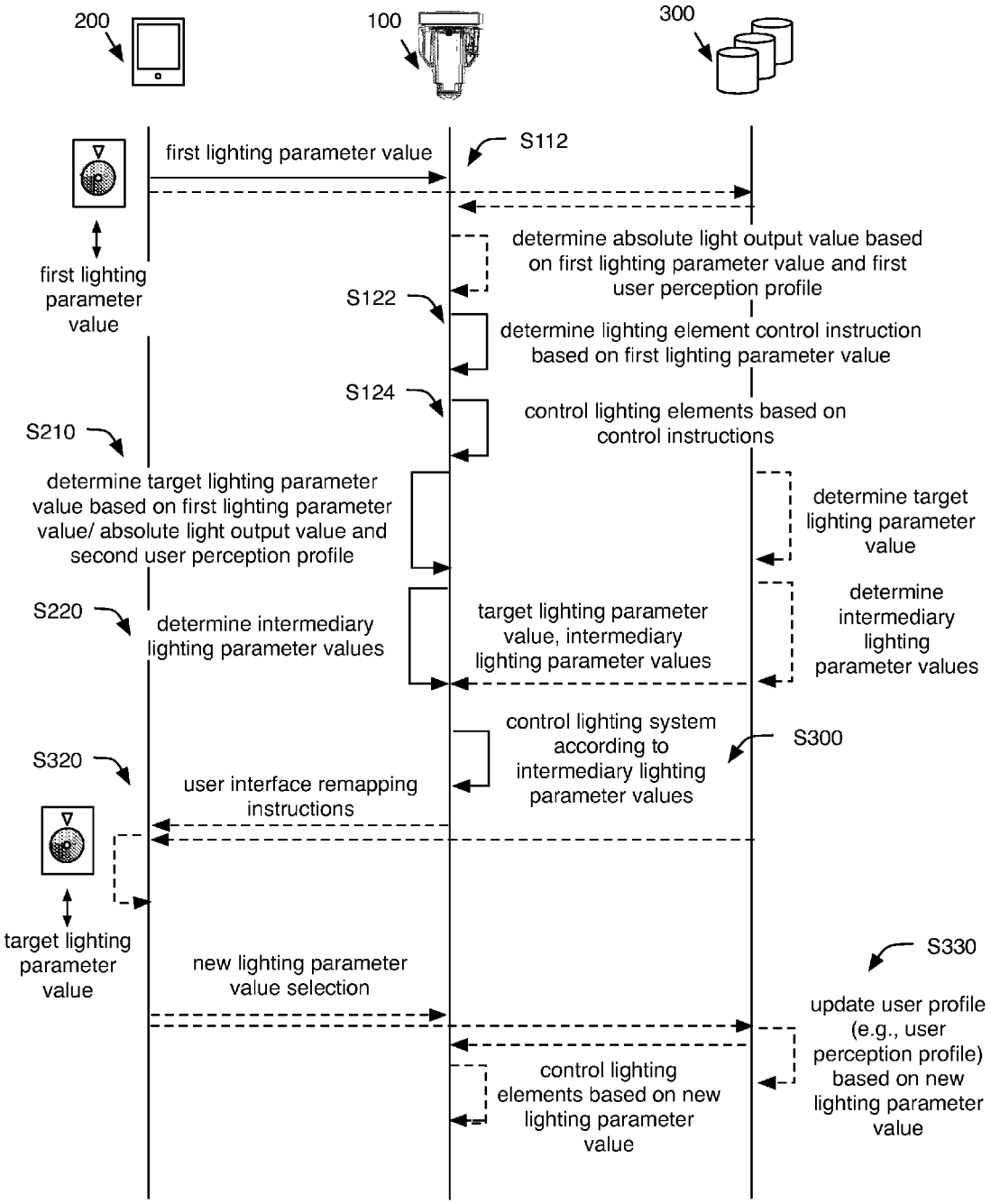
FIGS. 8 and 9 are a first and second example of the method, respectively.

In one variation, the user preferences are learned from user responses to the lighting system adjustment (example shown in FIG. 8). This can include: receiving a new lighting system control instruction from the user account, determining whether the new instruction was in response to the automatic adjustment, and updating the user profile in response to determination that the new instruction was entered in response to the automatic adjustment. The method can additionally include controlling the lighting system based on the new control instructions (e.g., controlling the lighting elements to meet the lighting parameter value specified by the control instructions). The new instruction can be categorized as a response to the automatic adjustment when: the lighting parameter changed by the new instruction is the lighting parameter that was adjusted; the new instruction is received within a threshold period of time; and/or when any other suitable condition is met.

Updating the user profile preferably includes updating the user perception profile for the user, but can alternatively include updating user preferences, tracking which lighting parameters the user is more or less sensitive to, or include extracting any other suitable set of information from the user input. In one example, the adjustment rate can be updated based on the user input time. In a specific example, the adjustment time can be decreased or the adjustment time period increased (e.g., such that the adjustment occurs over a longer period of time) when the user enters a new instruction within a predetermined time period after automatic adjustment initiation.

In a second example, the target light parameter value (second light parameter value) or method of determination can be adjusted based on the value of the light parameter at the time of user instruction input. In a specific example, the initial target light intensity value can be 80% of the initially selected intensity value, wherein the lighting system is controlled to decrease the emitted light intensity from the selected intensity value to the target intensity value. A control instruction to increase the light intensity is received from the user halfway through the adjustment (e.g., when the emitted light intensity is 90% of the selected intensity value). The user perception profile can be adjusted by remapping the actual light intensity value (corresponding to 90% of the selected intensity value) to a new perceived light intensity value. Alternatively, the second light parameter value determination method can be revised, wherein the second light parameter value can be 90%, instead of 80%, of the initially selected intensity value. However, the user profile can be otherwise updated.

The method can additionally include selectively controlling lighting element operation adjustment based on user location S400. More preferably, lighting element operation adjustment is based on user proximity to the lighting system, but can alternatively be based on user location within a specified geographic location, or be otherwise based on user location. In a first variation, the lighting element operation can be adjusted only when a user is proximal the lighting system. In a second variation, the lighting element operation can be adjusted whether or not a user is proximal the lighting system. In a third variation, the lighting element operation can be adjusted based on which user is proximal the lighting system (e.g., based on the identity of the users proximal the lighting system). However, the lighting system can be selectively controlled based on user location in any other suitable manner.

A user can be proximal the lighting system when the user is within a predetermined physical region associated with the lighting system. The physical region can be adjacent the lighting system (e.g., be the room or lighting system illumination area) or otherwise arranged. The physical region can be a geofence, a predetermined distance from the lighting system, or have any other suitable shape. The physical region can be universally defined (e.g., within 5 feet of any lighting system), specified by a user, defined by the reach of a wireless protocol, automatically determined (e.g., based on context), or be otherwise determined.

User location within the physical region can be determined using the user device. In one variation, the user can be located within the physical region when the user device location, as determined by the user device GPS system, trilateration system, or other geolocation system, is within the physical region. In a second variation, the user can be located within the physical region when the user device connects to a local network associated with the lighting system. In a first example, the local network can be generated by the lighting system and be a short-range communication protocol, such as NFC or beacon technology, wherein the physical region can be localized about the lighting system. In a second example, the local network can be a long-range communication protocol generated by the lighting system or an external router, such as WiFi or cellular, wherein the physical region can encompass a large region (e.g., a city block, a house, a room, etc.). In a third variation, the user device can record signals indicative of proximity to the lighting system (e.g., detecting modulated light emitted by the lighting system having an identifier for the lighting system). However, the user device can be used in any other suitable manner to approximate the user location.

Alternatively, user location within the physical region can be determined using sensor measurements. In one variation, the user is located within the physical region when an external sensor (e.g., a security camera, temperature sensor, occupancy sensor, lighting system sensor, etc.) detects user presence within the monitored physical region. However, the user location can be otherwise determined.

The method can additionally include accommodating multiple users. In one variation, accommodating multiple users can include detecting the presence of multiple users proximal the lighting system, retrieving user perception profiles and/or lighting modes for each user based on the user account, and generating a composite target light parameter value based on the multiple user perception profiles and/or lighting modes. In a second variation, the accommodating multiple users can include determining the location of each user relative to the lighting system; for each user, identifying a subset of lighting elements proximal the user; retrieving user perception profiles and/or lighting modes for each user based on the respective user account; and controlling each subset of lighting elements based on the user perception profile and/or lighting mode of the closest user.

Figure 10:
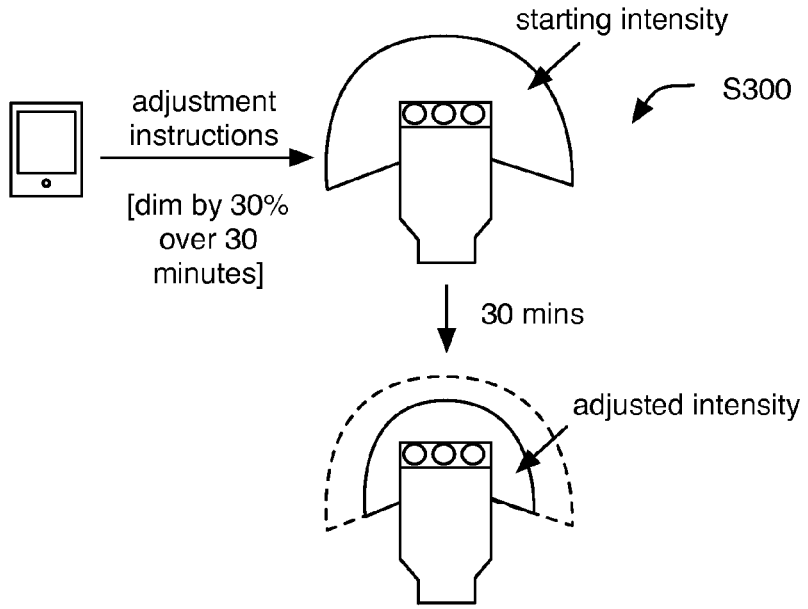
FIG. 10 is a schematic representation of an example of imperceptibly reducing power consumption by gradually decreasing the light intensity over a period of time.

In a first example as shown in FIG. 10, the method includes receiving a power saving mode selection at a user device, determining adjustment instructions to decrease lighting system power consumption, and sending the adjustment instructions to the lighting system, wherein the lighting system controls power provision to the lighting elements according to the adjustment instructions. Determining the adjustment instructions can additionally include selecting light intensity as the parameter to adjust to decrease power consumption. Determining adjustment instructions to decrease lighting system power consumption preferably includes determining a target intensity value and a time duration, wherein the lighting system incrementally adjusts lighting element operation parameters to meet the target intensity value in the given time duration. The adjustment rate is preferably determined based on the difference between the target intensity value and the instantaneous intensity value of the lighting element, but can alternatively be determined based on the adjustment limit or determined in any other suitable manner. Alternatively, determining adjustment instructions to decrease lighting system power consumption can include determining an intensity value change and a time duration, wherein the lighting system incrementally adjusts the lighting element operation parameters to meet the target value change in the time duration. However, any other suitable adjustment instructions can be determined.

In a second example, the method includes receiving a power saving mode selection at a user device, determining a target power consumption rate, selecting light hue as the parameter to adjust to decrease power consumption, determining the target hue required to achieve the target power consumption rate, and sending the target hue to the lighting system, wherein the lighting system controls the lighting elements to meet the target hue. Power consumption is preferably decreased by increasing the redness of the emitted light, but can alternatively be adjusted in any other suitable manner. Alternatively, power consumption can be decreased by increasing the blue hue of the emitted light, wherein the intensity of the emitted light can be concurrently or asynchronously decreased (e.g., because human eyes are more sensitive to blue light). The hue adjustment rate is preferably limited by the hue adjustment rate limit, but can alternatively be any other suitable rate. The hue adjustment rate is preferably determined by the lighting system, but can alternatively be determined by any other suitable system. The lighting system preferably controls lighting element operation based on the hue adjustment rate, but can alternatively control lighting element operation in any other suitable manner. In one variation, the hue is adjusted at a constant rate. In a second variation, the hue is adjusted at a variable rate. For example, the hue can be adjusted at a first rate when the instantaneous hue is above a threshold hue value, and adjusted at a second rate (different from the first rate) when the instantaneous hue is below a second threshold hue value. In a specific example, the hue can be slowly adjusted until the emitted light reaches the threshold hue, after which point the hue can be rapidly adjusted to meet the target hue value. However, the hue can be adjusted in any other suitable manner.

In a third example, the method includes receiving a power saving mode selection, determining a user orientation (e.g., based on the orientation of the user device when the mode selection was received, external sensor measurements, WiFi/RF reflections, PIR sensor measurements, etc.), determining the positions of each of a plurality of a set of lighting systems relative to a user, identifying a first lighting system in front of the user and a second lighting system behind the user, and generating a first set of adjustment instructions for the first lighting system and a second set of adjustment instructions for the second lighting system, wherein the first set of adjustment instructions is different from the second set of adjustment instructions. The first set of adjustment instructions can be to gradually increase the respective emitted light intensity, and the second set of adjustment instructions can be to gradually decrease the respective emitted light intensity. The intensity adjustment rate for the first and second set of adjustment instructions are preferably substantially equal, such that the total amount of light emitted by the first and second lighting systems at any time during the adjustment period is substantially constant, but can alternatively be different. For example, the second lighting system can be dimmed faster than the first lighting system is brightened. The first set of adjustment instructions can additionally include gradually decreasing the intensity of the light emitted by the first lighting system after the first lighting system has been brightened to a target intensity, after the second lighting system has been dimmed to a target intensity, or after any other suitable threshold has been met. Alternatively, individual lighting elements (e.g., LEDs) within each lighting system can be individually controlled based on the lighting instructions. In a first example, lighting elements proximal the user can be brightened and lighting elements distal the user can be dimmed. In a second example, lighting elements proximal the user of the first lighting system can be brightened, while lighting elements proximal the user of the second lighting system can be dimmed. However, subsets of lighting elements of the first and second lighting system can be otherwise controlled.

The adjustment instructions for each lighting system can be changed in response to user movement (e.g., based on the position sensor of the user device, based on external sensor measurements, WiFi/RF reflections, PIR sensor measurements, etc.). In one variation, the adjustment instructions for each lighting system can be newly determined in response to user movement. In a second variation, the previously determined adjustment instructions can be reassigned to different lighting systems. However, the new adjustment instructions can be otherwise determined. Lighting system operation adjustment is preferably not limited by the adjustment limit when adjusted in response to user movement, but can alternatively be limited in any suitable manner.

Figure 11:
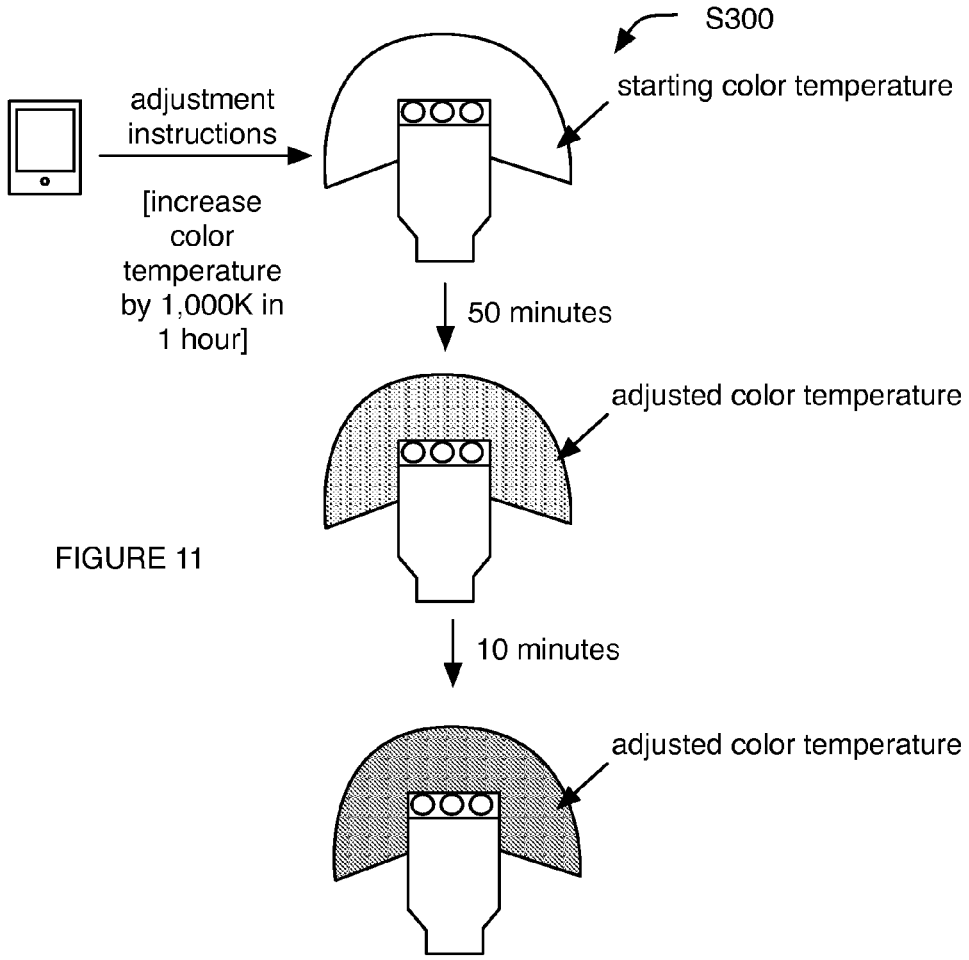
FIG. 11 is a schematic representation of an example of imperceptibly adjusting color temperature over a period of time.

In a fourth example, the method includes receiving a mood or physiological state selection, determining a target color temperature or lighting system parameter change associated with the selected mood, determining adjustment instructions based on the target color temperature and the instantaneous color temperature of the emitted light (e.g., based on a light sensor measurement), and sending the adjustment instructions to the lighting system, wherein the lighting system controls power provision to the lighting elements according to the adjustment instructions, an example of which is shown in FIG. 11. In a specific example, in response to receipt of a positive mood selection, a predetermined target color temperature (e.g., 2,700K) or percentage color temperature change (e.g., 30% warmer) can be selected. This example can additionally or alternatively be performed in response to detection of ambient environment parameters exceeding a threshold value. For example, the color temperature can be warmed in response to detection that the intensities of a set of ambient noise frequencies (e.g., frequencies indicative of crying or a fight) are exceeding a frequency threshold. In another example, the method leverages the Hawthorne effect to influence an aspect of the behavior or mood of a user in the illuminated space by noticeably changing one or more operation parameter values of the lighting system.

Figure 12:
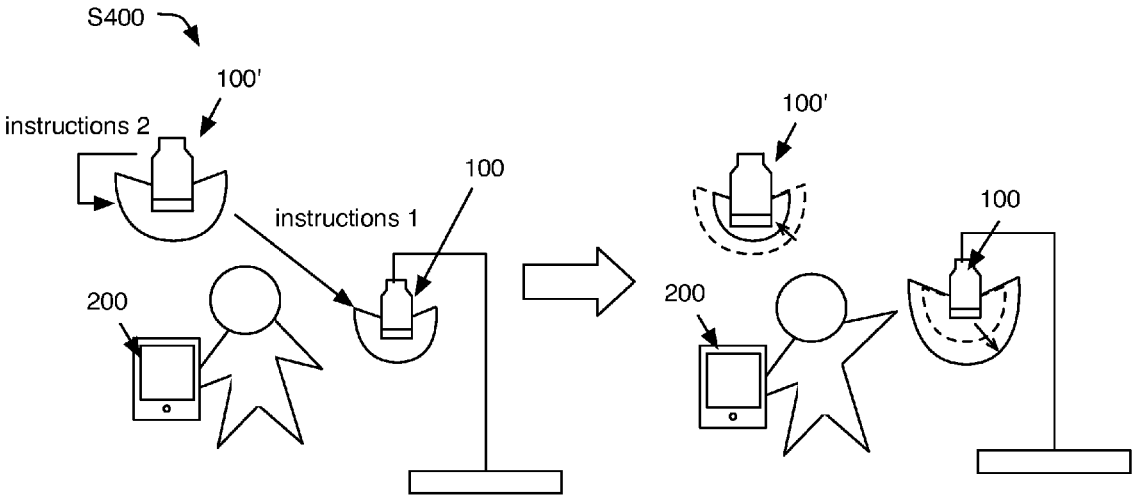
FIG. 12 is a schematic representation of an example of imperceptibly reducing power consumption by gradually increasing the intensity of light emitted by lighting systems having a larger influence on a user's perception of the ambient light and decreasing the intensity of light emitted by lighting systems having a smaller influence on a user's perception of the ambient light.

In a fifth example as shown in FIG. 12, the method includes detecting the presence of a user device within a threshold distance of the lighting system (e.g., the user device connects to the lighting system), retrieving lighting preferences for the user based on an identifier determined from the user device, and generating adjustment instructions to meet the lighting preferences. Alternatively, when multiple user devices are within the threshold distance of the lighting system (e.g., when two users are in a room), the preferred lighting parameter values can be compared and a composite set of lighting parameter values generated. The composite set of lighting parameter values can be generated by averaging the preferred lighting parameter values for the multiple users, selecting the most extreme values, or determined in any other suitable manner. Alternatively or additionally, the lighting elements or lighting systems closest to each user can reflect the preference for the respective user (e.g., adjusting the incident light on a focal point for color blindness). However, individual lighting systems or lighting elements can be otherwise controlled based on the respective user preferences.

In a sixth example, the method includes determining an anticipated rate of ambient light change (e.g., sunlight increase rate based on weather reports, light sensors, etc.), determining adjustment instructions to maintain the instantaneous ambient light parameters, and controlling the lighting system based on the adjustment instructions. For example, the light emitted by the lighting system can be decreased at the same rate as sunlight increase.

In a seventh example, the method can accommodate for renewable power supply fluctuations. In one variation, the method can include detecting an excess power event and generating instructions to accommodate for the excess power. The excess power event can be the power supply's power storage state of charge meeting or exceeding an SOC threshold, the anticipated net power supply exceeding the remaining capacity in power storage, or any other suitable event indicative of power supply power production in excess of the power storage capacity. The instructions can be generated to ramp up power consumption by the lighting system as the power production rate increases, to pre-emptively consume power from the power storage to decrease the power storage SOC such that the power storage can accommodate for the excess power, or to consume power in any other suitable manner without visually signaling the increased power consumption to the user through the lighting system. Alternatively, the accommodation event can be the power storage SOC falling below an SOC threshold, the anticipated power storage SOC falling below the SOC threshold, or any other suitable event indicative of power supply power production below the instantaneous power consumption rate. The instructions can be generated to decrease power consumption by the lighting system. However, any other suitable instructions can be generated.

Although omitted for conciseness, the preferred embodiments include every combination and permutation of the various system components and the various method processes.

As a person skilled in the art will recognize from the previous detailed description and from the figures and claims, modifications and changes can be made to the preferred embodiments of the invention without departing from the scope of this invention defined in the following claims.

I claim:

1. A method for automatic lighting system control, the lighting system including a lighting element, the method comprising:

receiving a first light intensity value from a user account associated with an identifier for the lighting system;

determining a first lighting element control instruction based on the first light intensity value;

controlling the lighting element according to the first lighting element control instruction;

determining lighting system association with a power reduction mode;

within a predetermined time period from first light intensity value receipt, automatically determining a second light intensity value based on the lighting system mode and first light intensity value, the second light intensity value lower than the first light intensity value; and incrementally adjusting lighting element operation to meet the second light parameter value over a second predetermined time period.

2. The method of claim 1, wherein the second light intensity value is selected based on a user perception profile, the user perception profile relating light intensity values with perceived light output values.

3. The method of claim 2, wherein the user perception profile is for the user account, the method further comprising:

receiving a third light intensity value from the user account, wherein the third light intensity value is between the first and second light intensity values after the first time;

determining a third lighting element control instruction based on the third light intensity value;

controlling the lighting element according to the third lighting element control instruction; and updating the user perception profile based on the third light intensity value.

4. The method of claim 2, wherein the lighting element operation is incrementally adjusted in response to determination that a user device associated with the user account is located within a predetermined physical region.

5. The method of claim 4, wherein the second light parameter value comprises a second light intensity value, the method further comprising:

determining second user device location within the predetermined physical region, the second user device associated with a second user account;

automatically determining a third light intensity value based on the first light intensity value and a second user perception profile associated with the second user account; and operating the lighting system based on the second and third light intensity values.

6. The method of claim 5, wherein the lighting system further comprises a second lighting element, the first and second lighting elements mounted to a first and second radial position on the lighting system, wherein operating the lighting system based on the second and third light intensity values comprises:

incrementally adjusting the first lighting element operation to meet the second light intensity value over the predetermined time period; and incrementally adjusting second lighting element operation to meet the third light intensity value over a second predetermined time period.

7. The method of claim 1, wherein the lighting element is controlled according to the first lighting element control instruction at a first time, and wherein incrementally adjusting lighting element operation to meet the second light parameter value over a second predetermined time period comprises:

determining a plurality of adjustment times after the first time;

determining an intermediary light intensity value for each adjustment time, wherein each intermediary light intensity value is between the first and second light intensity values;

determining an intermediary lighting element control instruction for each intermediary light intensity value; and at each adjustment time, controlling the lighting element according to the respective lighting element control instruction.

8. The method of claim 7, wherein:

the first lighting element control instruction comprises a first current magnitude corresponding to the first light intensity value; and the intermediary lighting element control instruction comprises an intermediary current magnitude, different from the first current magnitude, corresponding to the intermediary light intensity value.

9. The method of claim 1, wherein the first light intensity value corresponds to a first perceived light output value, wherein determining the second light intensity value based on the first light intensity value comprises:

determining a second perceived light output value based on the first perceived light output value; and selecting a light intensity value corresponding to the second perceived light output value as the second light intensity value, based on a user perception profile relating light intensity values with perceived light output values.

10. A method for automatic lighting system control, comprising:

receiving a first light parameter value selection from a user account associated with the lighting system;

controlling lighting elements of the lighting system to meet the first light parameter value;

automatically determining a second light parameter value based on the first light parameter value and a user perception profile relating light parameter values with perceived light output values; and incrementally adjusting lighting element operation to meet the second light parameter value over a predetermined time period.

11. The method of claim 10, wherein the user perception profile relates luminous flux with perceived luminous flux.

12. The method of claim 11, wherein the first light parameter value comprises a first luminous flux value, wherein controlling the lighting elements to meet the first light parameter value comprises controlling the lighting elements to meet the first luminous flux value.

13. The method of claim 12, wherein the first luminous flux value corresponds to a first perceived luminous flux value, wherein determining the second light parameter value based on the first light parameter value comprises:

determining a second perceived luminous flux value based on the first perceived luminous flux value; and selecting a second luminous flux value corresponding to the second perceived luminous flux value as the second light parameter value.

14. The method of claim 10, further comprising determining a lighting system mode based on an identifier for the lighting system, wherein the second light parameter value is determined based on the lighting system mode.

15. The method of claim 14, wherein the lighting system mode comprises a power reduction mode, wherein the first light parameter value comprises a first luminous flux value and the second light parameter value comprises a second luminous flux value lower than the first luminous flux value.

16. The method of claim 15, wherein controlling lighting elements to meet the first light intensity value comprises:

determining a current magnitude based on the first light parameter value; and supplying current at the current magnitude to the lighting elements; and wherein incrementally adjusting lighting element operation to meet the second light parameter value comprises: incrementally lowering the magnitude of the current supplied to the lighting elements.

17. The method of claim 15, wherein the first parameter value further comprises a first wavelength, wherein the second parameter value further comprises a second wavelength closer to 550 nm than the first wavelength.

18. The method of claim 10, wherein the user perception profile comprises an equation, wherein determining a second light parameter value comprises calculating the second light parameter value as a predetermined percentage of the first light parameter value, wherein the predetermined percentage is selected based on the first light parameter value.

19. The method of claim 10, wherein the lighting elements are operated to meet the first light parameter value at a first time, wherein incrementally adjusting lighting element operation to meet the second light parameter value over a predetermined time period comprises:

determining a second time separated by the predetermined time period from the first time;

determining a plurality of adjustment times between the first time and the second time;

determining a plurality of intermediary light parameter values between the first light parameter value and the second light parameter value, each intermediary light parameter value associated with an adjustment time; and in response to occurrence of an adjustment time, controlling the lighting element to meet the respective intermediary light parameter value.

20. The method of claim 10, further comprising:

recording an ambient light parameter value at a third time between the first and second times; and calculating a new intermediary light parameter value for an adjustment time of the plurality of adjustment times based on the ambient light parameter value, wherein the adjustment time is after the third time.

* * * * *